US005743419A

United States Patent [19]

King

[11] Patent Number: 5,743,419

[45] Date of Patent: Apr. 28, 1998

[54] CONTAINER CLOSURE WITH A REINFORCED RESILIENT BLADE

[75] Inventor: Roger M. King, Latimer, United Kingdom

[73] Assignee: Beeson and Sons Limited, Rickmansworth, United Kingdom

[21] Appl. No.: 470,351

[22] Filed: Jun. 6, 1995

Related U.S. Application Data

[63] Continuation-in-part of Ser. No. 380,201, Jan. 30, 1995, Pat. No. 5,588,545, which is a continuation of Ser. No. 121,970, Sep. 15, 1993, abandoned, which is a continuation of Ser. No. 796,946, Nov. 22, 1991, abandoned.

[30] Foreign Application Priority Data

Sep. 23, 1991 [GB] United Kingdom ..... 9120264
Oct. 17, 1991 [GB] United Kingdom ..... 9122097

[51] Int. Cl.[6] ..... B65D 55/02

[52] U.S. Cl. ..... 215/217; 215/219; 215/220; 215/330

[58] Field of Search ..... 215/217, 216, 215/218, 219, 220, 329, 330, 331, 305; 220/303

[56] References Cited

U.S. PATENT DOCUMENTS

| | | | |
|---|---|---|---|
| D. 207,887 | 6/1967 | Parsisson . | |
| D. 327,644 | 7/1992 | Offley et al. . | |
| D. 329,980 | 10/1992 | Powell et al. . | |
| 3,770,153 | 11/1973 | Gach et al. . | |
| 3,795,337 | 3/1974 | Nozawa et al. | 215/219 |
| 3,828,519 | 8/1974 | Levey . | |
| 3,888,375 | 6/1975 | Gerk . | |
| 3,907,155 | 9/1975 | Smith et al. | 220/303 X |
| 3,944,102 | 3/1976 | Grau . | |
| 4,011,829 | 3/1977 | Wachsmann et al. | 215/216 X |
| 4,093,096 | 6/1978 | Augros . | |
| 4,134,513 | 1/1979 | Mumford . | |

(List continued on next page.)

FOREIGN PATENT DOCUMENTS

| | | |
|---|---|---|
| 0 182 519 | 5/1986 | European Pat. Off. . |
| 0 443 868 | 8/1991 | European Pat. Off. . |
| 724431 | 4/1932 | France . |
| 2153305 | 5/1973 | France . |
| 704508 | 4/1966 | Italy . |
| 1 438 885 | 6/1976 | United Kingdom . |
| 2 011 869 | 7/1979 | United Kingdom . |
| 1 603 667 | 11/1981 | United Kingdom . |
| 2 114 552 | 8/1983 | United Kingdom . |
| 2 155 447 | 9/1985 | United Kingdom . |
| 2 203 729 | 10/1988 | United Kingdom . |
| 2 260 534 | 4/1993 | United Kingdom . |
| 2 261 656 | 5/1993 | United Kingdom . |
| 2 267 484 | 12/1993 | United Kingdom . |
| WO93/01098 | 1/1993 | WIPO . |

*Primary Examiner*—Allan N. Shoap
*Assistant Examiner*—Robin A. Hylton
*Attorney, Agent, or Firm*—Brinks Hofer Gilson & Lione

[57] ABSTRACT

A child resistant container closure assembly having a container neck and a container closure where the container closure has an inner part and an outer part. A first set of castellations are located on the inner part. A second set of castellations are located on the outer part and arranged to inter-engage the first set of castellations on the inner part when the outer part is moved axially towards the inner part to permit full torque to be applied to the inner part. A set of resilient blades extend from a first of the inner and outer parts towards a second of the inner and outer parts, the resilient blades bearing against the second of the inner and outer parts to urge the outer part axially in a direction away from the inner part such that the first and second sets of castellations are normally held out of inter-engagement. Each of the resilient blades having a remote end and having an abutment surface at the remote end, each of the resilient blades having a longitudinal cross-section which tapers towards the remote end, and a profile at an acute angle between each resilient blade and the closure part from which the resilient blade extends being radiused. At least one resilient blade is provided with at least one reinforcing rib extending longitudinally along the blade.

6 Claims, 5 Drawing Sheets

U.S. PATENT DOCUMENTS

| | | | |
|---|---|---|---|
| 4,213,534 | 7/1980 | Montgomery . | |
| 4,280,631 | 7/1981 | Lohrman . | |
| 4,413,743 | 11/1983 | Summers . | |
| 4,480,760 | 11/1984 | Schonberger . | |
| 4,527,701 | 7/1985 | Schaubeck . | |
| 4,605,135 | 8/1986 | Ryder . | |
| 4,754,892 | 7/1988 | Retief . | |
| 4,782,965 | 11/1988 | Wassilieff . | |
| 4,957,210 | 9/1990 | Kusz . | |
| 4,997,096 | 3/1991 | Kusz . | |
| 5,009,338 | 4/1991 | Barker | 215/230 |
| 5,020,681 | 6/1991 | Kusz . | |
| 5,103,991 | 4/1992 | Collins . | |
| 5,213,225 | 5/1993 | King et al. . | |
| 5,219,084 | 6/1993 | King . | |
| 5,411,157 | 5/1995 | King et al. . | |

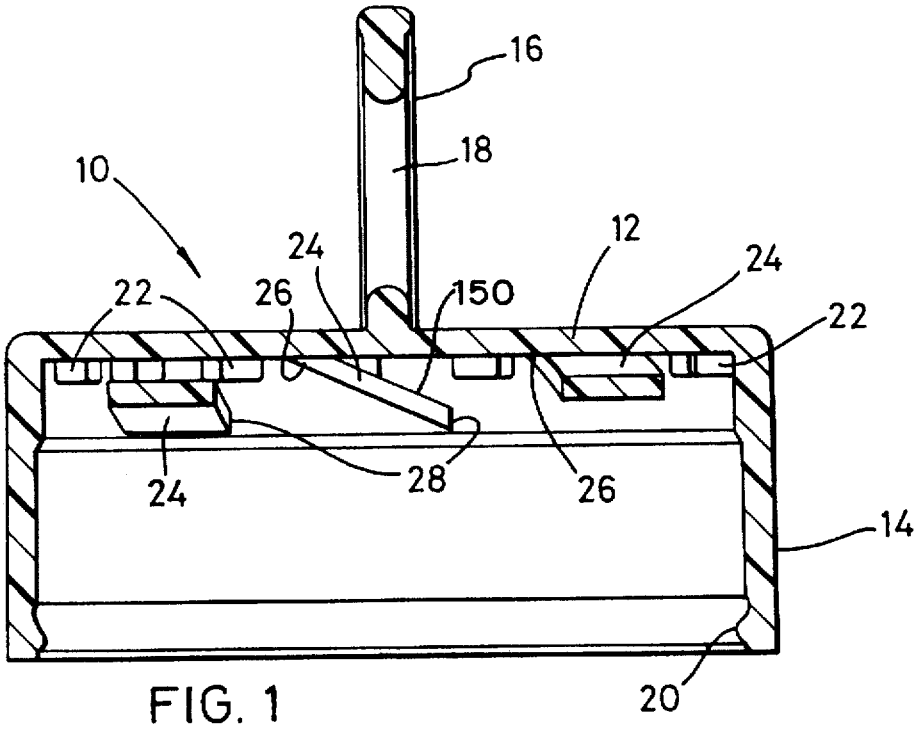
FIG. 1
FIG. 2
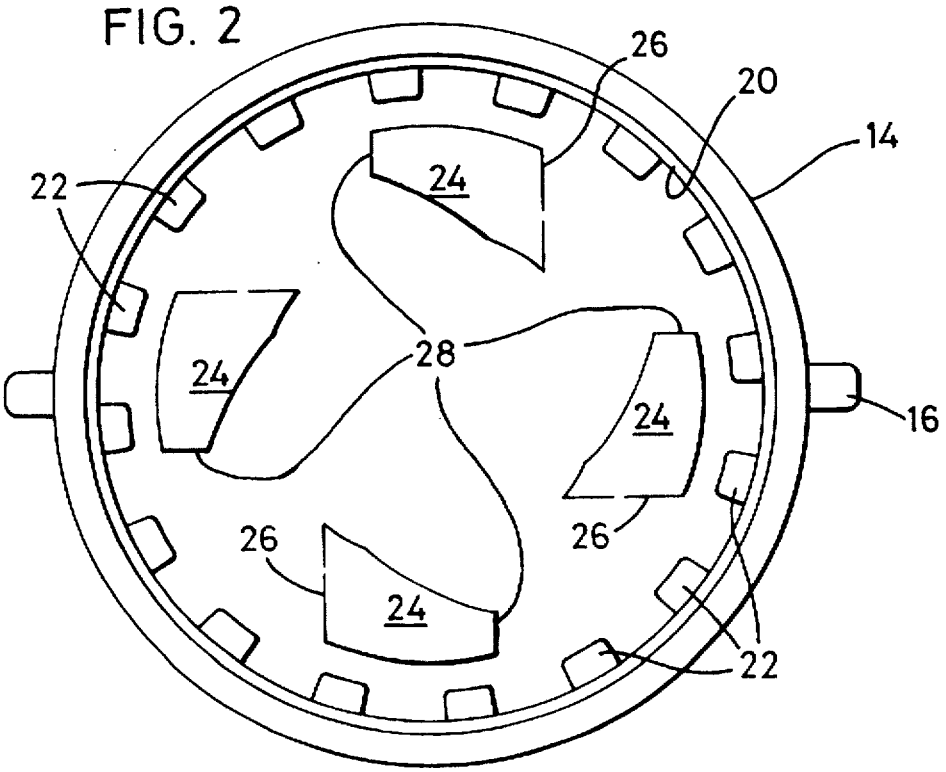

CONTAINER CLOSURE WITH A REINFORCED RESILIENT BLADE

This is a continuation-in-part of application Ser. No. 08/380,201, filed Jan. 30, 1995, now U.S. Pat. No. 5,588, 545, which was a continuation of U.S. patent application Ser. No. 08/121,970, filed Sep. 15, 1993, now abandoned, which was a continuation of U.S. patent application Ser. No. 07/796,946, filed Nov. 22, 1991, now abandoned.

BACKGROUND OF THE INVENTION

1. Field of the Invention

The invention relates to closures for containers.

In this specification, a so-called "child-resistant" closure (hereinafter referred to as a "relevant child-resistant closure") comprises an inner closure part adapted to be enaged with the neck of a container by rotation in one sense and to be disenaged therefrom by rotation in the other sense; an outer closure part capable of being moved relative to the inner closure part between a predetermined rest position and a displaced position; means to rotate the inner closure part with the outer closure part on rotation of the latter in the the one sense when the outer closure part is in either of its rest position and its displaced position; and means to rotate the inner closure part with the outer closure part on rotation of the latter in the the other sense when the outer closure part is in its displaced position, but when the outer closure part is in its rest position only when any torque resisting rotation of the inner closure part is below a predetermined threshold, wherein the outer closure part is capable of adopting its displaced position only when its angular displacement with respect to the inner closure part is within any one of a number of predetermined discrete angular ranges.

The closure according to the invention is particularly suitable for use in the arrangements described in U.S. patent application Nos. 066546 (now U.S. Pat. No. 3,454,496) and/or 193610 (pending), the disclosures of which applications are included herein by way of reference.

DESCRIPTION OF THE PRIOR ART

Many known child-resistant closures include a plurality of equidistant ramps on the outer surface of a crown portion of the inner closure part which cooperate with a plurality of equidistant, resilient oblique blades extending inwardly from a crown portion of the outer closure part. When viewed from the center of the respective closure parts, the ramps have a right triangular section comprising a horizontal base, a vertical left side and a hypotenuse and the blades extend diagonally downward from the left towards a lower right free end.

When the outer closure part is rotated clockwise, i.e. in a right-handed sense, the free ends of the blades abut the vertical faces of the ramps, thereby driving the inner closure part with the outer closure part.

When rotation of the outer closure part is effected in the other, left-handed sense, ie. counter-clockwise, the blades simply trail over the ramps in the manner of a ratchet, the inner closure part being fixed on the container by its closure torque.

Typically, castellations are provided on both inner and outer closure parts which mate when the outer closure part is depressed. The inner closure part is then bound to rotate with the outer closure part. When the outer closure part is released, the blades act as leaf springs to return it to its rest position, in which the castellations are disengaged.

Child-resistant closure systems normally rely on the ability of the closure to spring apart, every time, after pressure has been applied, generally at right angles to the plane of the thread. If, even on rare occasions the two parts of the closure do not spring apart and disenage, the child-resistant feature of the closure no longer functions. It is therefore essential that the resilient blades acting as leaf springs have and continue to retain sufficient resilience to exert sufficient pressure to force the two parts of the closure apart in order that there is disengagement at all times, apart from occasions when direct and sufficient pressure is applied to engage the closure system. The main failure of existing systems to work properly at all times is due to the weakness of the resilient blades, which in the past have typically been made of uniform thickness, with a sharp angle on the inside edge where the blade joins the flat face of the underside of the top part of the closure. This design is potentially unsatisfactory as the blades can weaken at the point of joining the flat plane of the underside of the top part of the closure, and the blades themselves tend to be stiff and as a result do not flex along the length of the blade.

It is an object of the present invention to overcome this problem and to ensure more flexibility and to ensure that the blades retain their resilience and hence the ability to force the two parts of the closure apart, and also to ensure that when being closed the planes of the top and lower part of the closure remain in parallel.

SUMMARY OF THE INVENTION

The present invention provides a child resistant container closure assembly including:

a container neck and a closure;

the container neck carrying a first thread;

the container closure including an inner part and an outer part;

the inner part carrying a second screw thread for screw threaded engagement with the first screw thread on the container neck;

co-operating retaining projections on the inner and outer parts for retaining the inner part within the outer part, and for permitting limited axial movement of the inner part within the outer part;

a first set of castellations on the inner part;

a second set of castellations on the outer part arranged to inter-engage the first set of castellations on the inner part when the outer part is moved axially towards the inner part to permit full torque to be applied to the inner part;

a set of resilient blades extending from a first of the inner and outer parts towards a second of the inner and outer parts, the resilient blades bearing against said second of the inner and outer parts to urge the outer part axially in a direction away from the inner part such that the first and second sets of castellations are normally held out of inter-engagement;

each of the resilient blades having a remote end and having comprising an abutment surface at the remote end, each of the resilient blades having a longitudinal cross-section which tapers towards the remote end, and the profile at the acute angle between each the resilient blade and the closure part from which the resilient blade extends being radiused;

the second of said inner and outer parts having a set of adjacent ratchet projections, each of the ratchet projections having a stop surface and a ramp surface, the stop surface being substantially radial and being constructed and arranged to engage the abutment surface of one of the resilient blades when the outer part is rotated in a first direction to apply the closure to the neck, thereby to permit full torque to be applied to the inner part in the first direction of rotation;

each the ramp surface being constructed and arranged to cam one of the resilient blades over the ratchet projection when the outer closure part is rotated in a second direction opposite to the first direction so that the blades can slip relative to the ratchet projections if the outer part is rotated in the second direction without the first and second sets of castellations being in interengagement, the resilient blades transmitting only a limited torque to the ratchet projections owing to frictional engagement of the resilient blades slipping over the ramp surfaces of the ratchet projections.

Preferably, one or more of the resilient blades has a tranverse cross-section which also tapers towards the remote end of the resilient blade.

Preferably, at least one of the resilient blades is provided with at least one reinforcing rib extending longitudinally along the resilient blade. Preferably, the reinforcing rib or ribs are formed integrally with the resilient blade, and preferably the reinforcing rib or ribs extend along the rear surface of the resilient blade, i.e. along the surface that does not face the ramp surfaces of the other closure part in use. More preferably, at least one of the reinforcing ribs has a longitudinal and/or a tranverse cross-section which tapers towards the remote end of the resilient blade. It has been found that such reinforcing ribs greatly improve the resilience and durability of the resilient blades without seriously reducing their flexibility. It has also been found that such reinforcing ribs make it still more difficult to bend the resilient blades out of shape by over-tightening the outer closure part on the inner closure part. Consequently, the reinforcing ribs enable the resilient blades to be made sufficiently flexible for the container to be easy to open even by elderly or infirm people, but also provide sufficient durability to ensure that the container remains child resistant even after a large number of opening operations.

Preferably, the closure assembly according to the present invention comprises four of the resilient blades and sixteen of the ratchet projections.

Another problem arises where a closure is primarily intended for use by the elderly, and hence must be easy to open, but which, for safety, must be child-resistant. The number of castellations provided on known child-resistant closures is normally two, three, or four, but this can require the closure to be rotated for up to 180° before engagement of the castellations can take place. Engagement after a much smaller rotation is desirable, and according to preferred embodiments of the invention there is provided a container neck and closure therefor wherein the closure moves from fully closed to a fully open postion by relative rotation through less than 360°, preferably approximately 90° or less, and the number of said castellations being such that angular displacment of the outer closure member relative to the inner closure member between adjacent positions in which the outer closure member can move to its displaced position is not greater than 45°, and preferably not greater than 25°. A preferred angular displacement is 22.5°, in which case, from a normal rest position, the outer closure would move to a position where it could be moved into its displaced position by rotation through 12.25° relative to the inner closure member. This preferred arrangement is provided by the closure having sixteen castellations, in which the maximum turn required for engagement is only one sixteenth, i.e. 22.5°. This is an important feature when used in conjunction with the container and closure of the U.S. patent application No. 07/706,891 (now U.S. Pat. No 5,213,225), where, in the preferred embodiment, the closure can be removed in only a quarter turn, and the addition of the child-resistant feature does not reduce the capacity to open the closure in approximately a quarter turn. This feature particularly assists and supports ease of opening for the elderly and frail with only a twist of the wrists, without the necessity to let go of the closure of the container, even though being child-resistant.

The number of ramps in known closures varies, but is commonly three, four or six. The number of resilient blades should be greater than two for stability, and should be a factor of the number of ramps.

In the past it has been arranged that the discrete angular ranges of angular displacement of the disclosure parts at which the castellations may engage one another is one in which the free ends of the blades on the outer closure part lie between the ramps on the inner closure part.

A result of this is that it is perfectly possible for a container on which such a closure is installed to be left with the closure parts so oriented that the castellations may be engaged simply by immediate depression of the outer closure part. Such a situation can occur where a closure has been installed with the outer closure part depressed, or where an adult has depressed the outer closure part, but then changed his or her mind about removing the closure.

The present invention seeks to overcome the above problem, and accordingly preferred embodiments of the invention comprise means for biasing rotationally the outer closure part relative to the inner closure part from each angular displacment at which the outer closure part can adopt its displaced position to a respective angular displacement at which the outer closure part cannot adopt its displaced postion. Preferably, the rotational biasing means exerts a torque which is greater in absolute value than any frictional torque resisting relative rotation of the closure parts.

In the preferred case, at no time can the closure of the invention be left in a condition at which immediate movement of the outer closure part from its rest position to its displaced position is possible. The outer closure part must first be rotated against some restoring force before such displacement can be effected.

In the case where the friction between closure parts is sufficient to resist the restoring torque, enabling the closure to be left in a "primed" condition as it were, an advantage still obtains. Subsequent handling of the closure or the container to which the closure is attached, such as setting the container down, dropping it, picking it up, casting it into a "medicine box", will in most cases be sufficient to cause the outer closure part to move somewhat relative to the inner closure part. The outer closure part will then come to rest nearer to, if not actually at, the repective angular displacement.

It is therefore extremly difficult, in normal usage, to leave the closure in a "primed" condition.

The means to rotate the inner closure part with the outer closure part includes a ratchet mechanism which restricts rotation of the outer closure part relative to the inner closure part in the one sense, but permits such rotation in the other sense.

Preferably, the rotational biasing means includes the ratchet mechanism.

Preferably, the number of the discrete angular ranges at which the castellations can be engaged is equal to the number of stable positions of the ratchet mechanism. When the closure is for use in an arrangement as disclosed in U.S. patent application No. 706891, it is advantageous for the number of the discrete angular ranges to be at least eight, preferably sixteen. This preserves the ability of the closure to be removed with a relatively small amount of rotation.

According to preferred embodiments of the invention, there is provided a container and closure as claimed in U.S. patent application No. 706891 or according to the invention of this application wherein the container neck and the container closure have fully engaging thread profiles to prevent play between the container and closure and ensure axial movement of the closure on the container. The threads may be of square section, rather than conventional "V" section threads to provide maximum stability when the threads first engage, and increasingly thereafter, whereby in conjunction with the four threads as described in U.S. patent application No. 706891, the square section thread ensures that the closure is screwed down to its closed position in a parallel plane, thereby making for easier engagement of the child-resistant closure in one simple turn of the wrist. The same applies when opening.

According to these embodiments of the invention, there is provided a container and closure therefor wherein the closure and container includes means for retaining the closure in a closed position on the container neck, the retaining means holding, in use, the closure in the closed position sufficiently strongly for the outer closure part to be rotatable in said other sense relative to said inner closure part when the inner part is in the rest position.

The retaining means ensures the functioning of the child-resistant closure, whereby when closed the resistance to opening is sufficiently strong for the child-resistant feature to operate, but is sufficiently weak to be overcome with ease when the castellations are properly engaged by an adult. The retaining means may be as described in U.S. patent application No. 706891, the disclosure of which is incorporated herein by way of reference. This feature provides the advantage that, upon engagement of the closure system, the closure is held on the container such that the child-resistant closure mechanism operates effectively but that the closure can be released, once the closure outer part is moved to the displaced position, by application of a predetermined torque. Conventional resilient-blade type child-resistant closures are screwed onto a neck thread with more than a 360° turn for closure. In order for all such conventional child-resistant systems to operate it is essential that they are screwed up very tightly, when being closed, otherwise the child-resistant system does not become operational at all, thus obviating the pupose of the child-resistant system. The weakness of conventional child-resistant systems is therefore evident, as arthritic, weak and elderly users are unable to close such containers sufficiently tightly, either to close them properly, or, even if they were closed tightly, perhaps by somebody else, then to open them. The preferred embodiment of this invention overcomes this problem, whereby the closure does not have to be closed tightly in order for the child-resistant system to become operable, and therefore is particularly effective for the arthritic, weak and elderly, as this combination of new closure systems enables the container, bottles and closure to be opened and closed easily, in approximately a quarter of a turn, with an effective child-resistant system.

A still further feature concerns the combination of the child-resistant closure system, together with a tamper-evident ring.

Additionally, the closure preferably includes the feature of additional support for the means of opening including an upstanding flange, or side flanges, to assist in applying torque when opening the closure. Preferably, the closure and container neck is as defined in the invention of U.S. patent application No. 706891, the disclosure of which is incorporated herein by way of reference, giving the advantage that, as the retaining force of the closure system is overcome, and the turning of the closure relative to the container neck starts, combined with the angle of the four threads and the quarter turn required to open, whereby the closure is given sufficient rotational acceleration and thrust to shear through the connections between the tamper-evident ring and the closure in such a manner as to overcome easily the resistance necessary for the tamper-evident ring to be separated from the closure even with the incorporation of the child-resistant system.

In further preferred embodiments the invention provides a container neck and closure therefor, the closure being a child-resistant closure, the number of predetermined discrete angular ranges being such that angular displacement of the outer closure member relative to the inner closure member between adjacent positions in which the outer closure member can move to its displaced position is not greater than 45°, the closure including means for biasing rotationally the outer closure part relative to the inner closure part away each angular position at which outer closure part can move to its displaced position.

In a further preferred embodiments the invention provides a container neck and closure, the closure being a child-resistant closure, the closure having an upstanding diametric handle, the number of predetermined discrete angular ranges being such that the angular displacment of the outer closure member relative to the inner closure member between adjacent positions in which the outer closure member can move to its displaced position is not greater than about 22.5°, and thereafter the closure can be moved from a fully closed to a fully open position by relative rotation of approximately 90°.

In further preferred embodiments the invention provides a container neck and closure, the closure being a child-resistant closure, the neck and closure having a tamper-evident ring, and the closure having an upstanding diametric handle, in use, to enable a user to better grip the closure to apply a torque to break the tamper-evident ring.

In further preferred embodiments the invention provides a container neck and closure, the closure being a child resistant closure, the container and closure having fully engaging thread profiles to prevent play between the container and closure and ensure axial movement of the closure on the container, the closure being movable from a fully opened to a fully closed position by relative rotation of approximately 90°, and the container and closure further including retaining means for retaining the closure in the closed position.

In further preferred embodiments the invention provides a container neck and closure thereform the closure being a child-resistant closure, wherein the angular positions at which the outer closure member can move to its displaced position are defined by castellations on each of the inner and cuter closure members, there being sixteen equally angularly spaced castellations on at least one of the inner and outer closure members, which castellations mate when the outer closure member is depressed, the closure further including resiliently biased ratchet means for biasing the inner and outer closure members apart and for restricting rotations of the outer closure part relative to the inner closure part in the one sense, but permitting such rotation in the other sense when the castellations are not engaged, the ratchet means further biasing the outer closure member in a rotational direction away from the angular positions at which the outer closure member can move to its displaced position, in use, the closure being movable from a fully open to a fully closed position by relative rotation of approximately 90°, and the container neck and closure further including retaining means for holding, in use, the closure in the closed position sufficiently strongly for the outer closure part to be rotatable in the other sense relative to the inner closure part when the inner part is in the rest position.

Preferred embodiments of a container and closure assembly according to the present invention will now be described with reference to the accompanying drawings, in which:

BRIEF DESCRIPTION OF THE DRAWINGS

FIG. 1 is a longitudinal sectional view of the outer closure part of the closure;

FIG. 2 is an underneath view of the outer closure part of FIG. 1,

Figure 3:
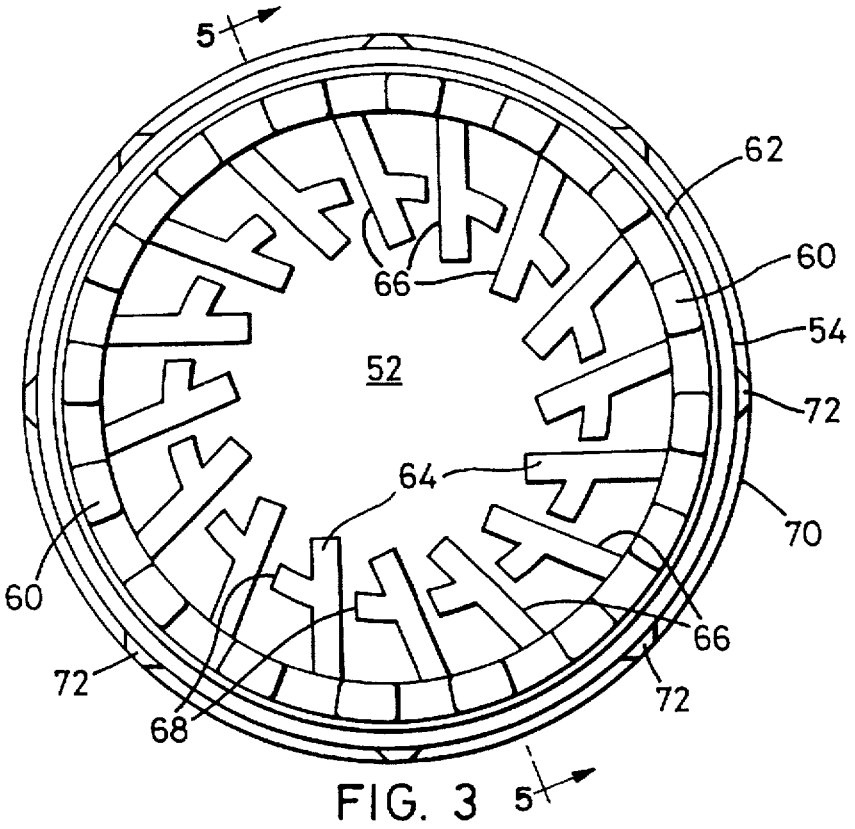
FIG. 3 is a plan view of the inner closure part of the closure.

As can be seen from FIG. 1, an outer closure part 10, constructed of moulded plastics (other suitable materials may be used), consists of a crown portion 12 and a skirt portion 14. The crown portion is provided on its outer surface with a diametric handle 16. The particular form of handle shown includes a central opening 18. Towards the lower, free end of the skirt portion 14, there is provided an inwardly extending bead 20, whose purpose is to retain the outer closure part on the inner closure part as will be described below.

Both FIGS. 1 and 2 illustrate that the inner surface of the crown portion 12 is provided with sixteen equidistant castellations 22 of substantially rectangular form and four equidistant oblique resilient blades 24. The resilient blades 24 extend circumferentailly from an upper, left-hand end 26, when viewed from the centre of the closure part, to a lower, right-hand free end 28.

As can be seen from FIGS. 3 to 6, an inner closure part 50, is constructed of moulded plastics (other suitable materials may be used), which includes a crown portion 52 and a skirt portion 54. The inner surface of the skirt portion 54 is provided with coarsely pitched threads 56 of square section 56 and vertical ribs 58, the function and purpose of which are described in detail in U.S. patent application No. 066,546. The top of the skirt portion 54 is provided with a tapered surface, the function and purpose of which is described in detail in U.S. patent application No. 193,610. Depending from the lower end of the inner closure part skirt portion 54 is a tamper-evident ring 70 which will be described below.

The crown portion 52 is provided around its periphery with sixteen upstanding, substantially rectangular castellations 60. These castellations 60 are adapted to engage the complementary castellations 22 on the outer closure part (see FIG. 2) 10. The outer periphery of the skirt portion 54 includes an outstanding ridge 62 below which, when the inner 50 and outer 10 closure parts are assembled, the bead 20 on the outer closure part 10 is retained. A degree of axial movement of the outer closure part 10 with respect to the inner closure part is permitted to engage and disengage the two sets of castellations 60,22.

Figure 5:
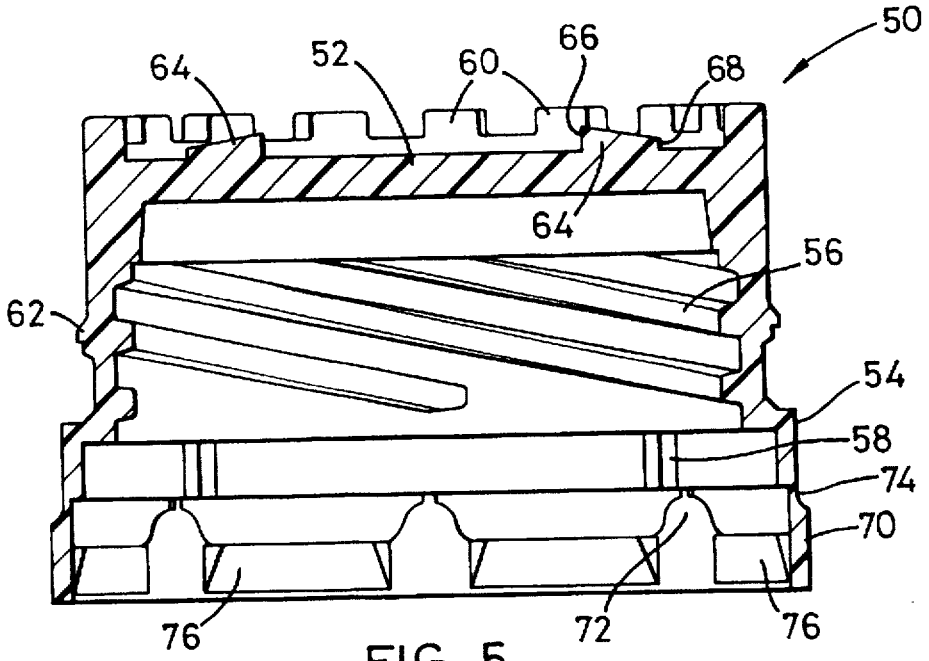
FIG. 5 is a longitudinal sectional view of the inner closure part of FIGS. 3 and 4 taken along line 5—5 of FIG. 3, where non-sectioned portions of the ramps on the crown portion of the inner closure part have been omitted for the sake of clarity.

Partly shown in FIG. 5, but fully in FIG. 3, are sixteen equidistant ramps 64, provided on the upper surface of the inner closure part crown portion 52. When viewed from the center of the closure part, each ramp 64 is of substantially right triangular cross-section having a horizontal base, a vertical left-hand side 66 and a hypotenuse, terminating in a right-hand side 68.

When the outer closure part 10 is installed on the inner closure part 50, and the outer closure part 10 is rotated clockwise, the free ends 28 of the resilient blades 24 abut against the vertical side 66 of their respective ramps, thus rotating the inner closure part 50 with the outer closure part 10. However, assuming the the inner closure part 50 is reasonably tightly held in place, e.g. by a closure torque, then rotation of the outer closure part 10 counter-clockwise will merely result in the resilient blades 24 trailing over the ramps 64 in the manner of a ratchet mechanism.

In order for the inner closure part 50 to be rotated counter-clockwise, it is necessary for the outer closure part 10 to be depressed against the action of the resilient blades 24 to allow the complementary castellations 22, 60 to engage.

The handle 16 enables the elderly and frail more easily to apply the force required to push down and engage the two parts of the closure, whilst at the same time the handle 16 makes it easy to turn the closure to open it. When closing the same principle and advantages apply. The handle 16 therefore makes the closure much easier to operate, in spite of the child-resistant feature, compared with standard child-resistant closures which many people, not just children, find difficult to open.

Alternatively, the handle 16 may be substituted by four side flanges to the outer closure part 10 which again enables easier opening and closing, or a standard cap with ribbed outer edges.

The relative angular displacements at which the complementary castellations 22, 66 may be engaged correspond to positions in which the free ends 28 of the resilient blades 24 have already travelled some distance along and up their respective ramps 64. They therefore correspond to positions of increased potential energy. The resilience of the blades 24 is such that, when the outer closure part 10 is released in such a displacement, the free ends 28 of the blades tend to move back down the sloping surfaces of the ramps 64 to their right hand sides 68. Once this has occurred, the complementary castellations 60, 22 are no longer so oriented as to be immediately engageable with one another.

Thus, all the rotationally stable positions of the outer closure part 10 with respect to the inner closure part 50 correspond to orientations of the castellations 22, 60 in which they cannot immediately be engaged solely by depression of the outer closure part 10.

Figure 4:
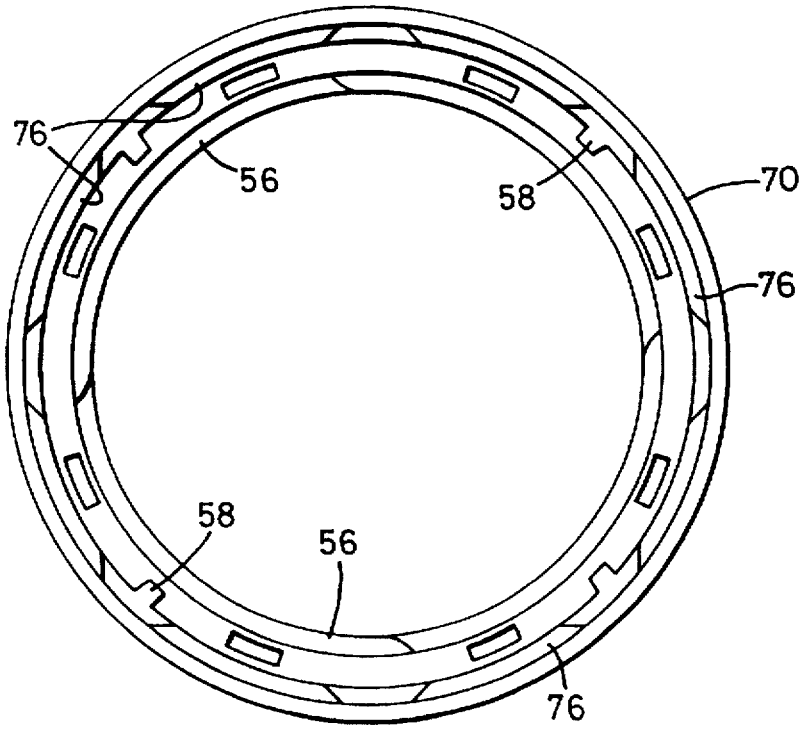
FIG. 4, is an underneath view of the inner closure part of FIG. 3.
Figure 6:
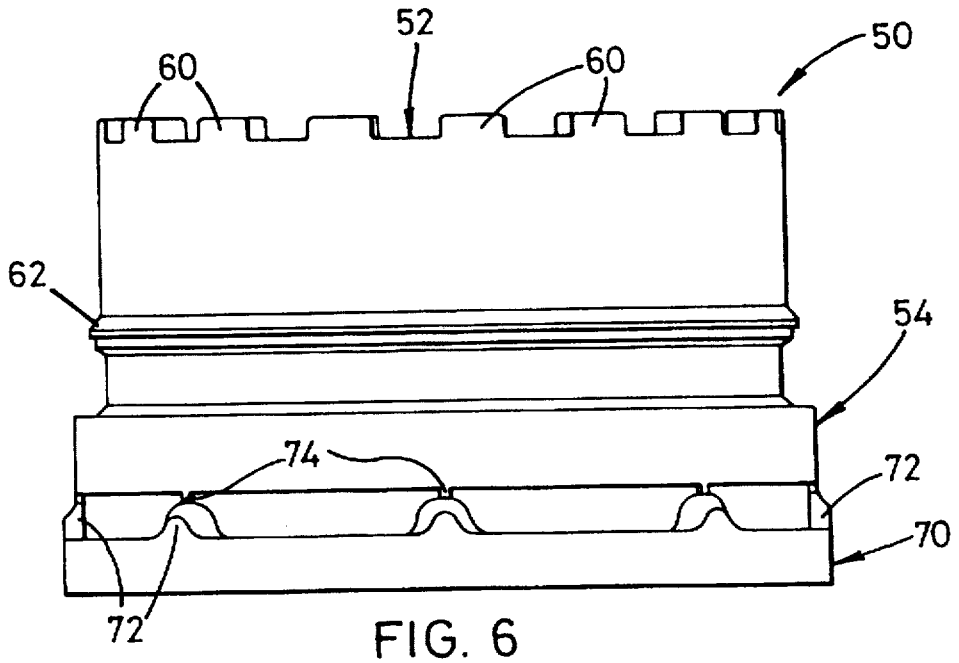
FIG. 6 is a side view of the inner closure part of FIGS. 3 to 5.

The tamper-evident ring 70 carried by the inner closure part 50 is shown in detail in FIGS. 4 to 6. Attached to the top of the ring and integral therewith are eight connecting members 72 which taper upwards from a relatively thick lower region into a relatively thin frangible bridge 74 attached to the inner closure part skirt portion 54. On the inside of the tamper-evident ring 70, extending between the connecting members are eight triangular section ring retaining clips 76 which are adapted to engage a circumferential projecton on the outer surface of the container neck.

Figure 7:
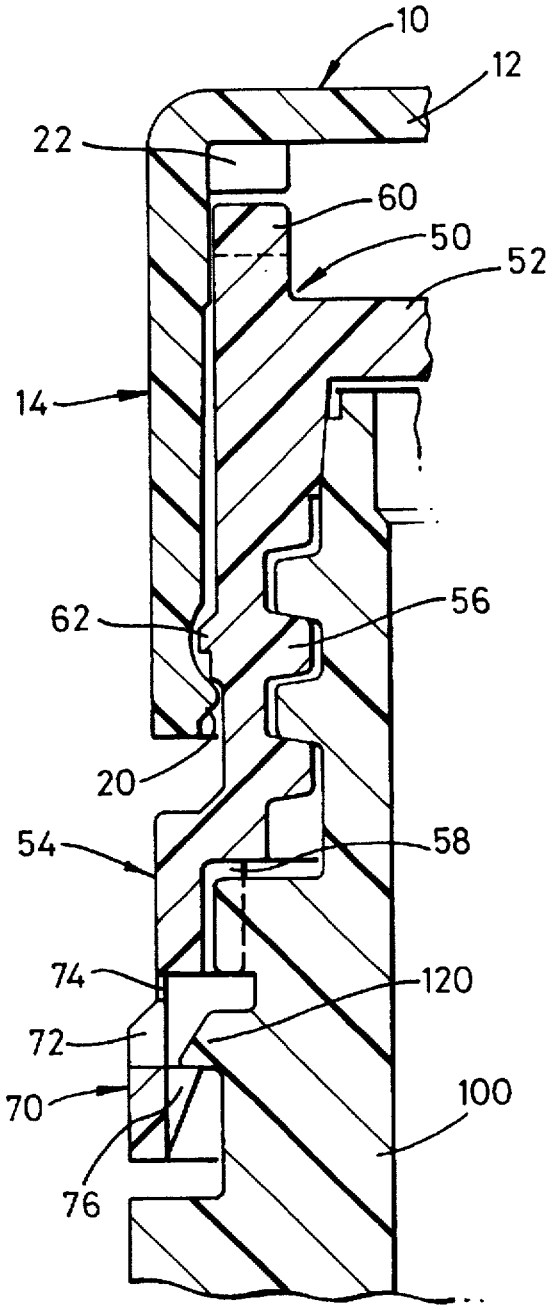
FIG. 7 is a partial longitudinal sectional view of the assembled closure retained on a container neck.

The assembled closure is shown in FIG. 7, and specific details of the thread 56 and vertical rib 58 and the seal between closure and container 100 may be found in our patent specifications cited herein. As can be seen in FIG. 7, the thread is essentially square in cross-section, providing positive and axial alignment of the two closure parts. The container 100 includes an outstanding circumferential projection 120 which is engaged by the ring retaining clips 76. Unscrewing the closure will result in the frangible bridges 74 being stretched and broken.

Figure 8:
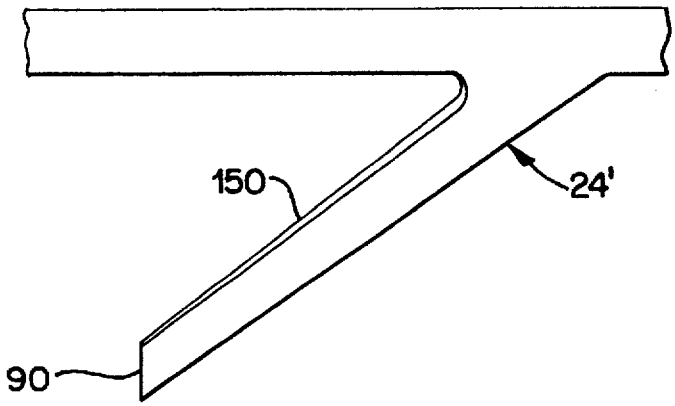
FIG. 8 is a side view showing the profile of a resilient blade in the form of a leaf spring.

Referring to FIG. 8, the resilient blade 24 is thicker at its base, becoming progressivley thinner towards its free edge 90. The joint of the resilient blade 24 with the remainder of the outer closure part 10 is radiused to provide extra strength. This profile gives sufficient resilience and strength to the resilient blade 24 to ensure that the outer closure part 10 and inner closure part 50 are always separated until axial pressure is applied to counteract the bias of the resilient blade 24. The durability of the resilient blade is further improved, without substantially increasing the force required to flex the blade, by the provision of a longitudinal integral reinforcing rib 92 extending along the rear surface 150 of the blade, i.e. along the surface that does not face the ramp surfaces of the closure part in use. This reinforcing rib also makes it more difficult to deform the blade by the application of excessive closure torque when screwing the closure onto the container neck.

Figure 9:
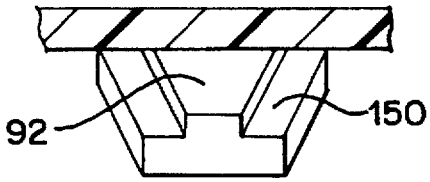
FIG. 9 is perspective view of a resilient blade having a tapered longitudinal reinforcing rib.

Referring to FIG. 9, in alternative embodiments, the reinforcing rib itself may be tapered along the length of the resilient blade in order further to optimize the flexibility and durability of the blade.

Figure 10:
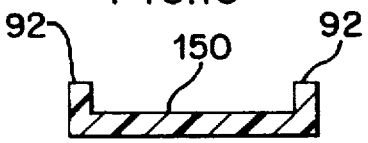
FIG. 10 is a tranverse cross section through a resilient blade in an alternative embodiment of the invention, wherein the resilient blade has two longitudinal reinforcing ribs.
Figure 11:
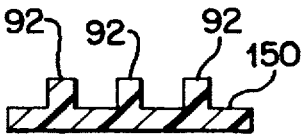
FIG. 11 is a tranverse cross section through a resilient blade according to a further embodiment of the invention, in which there are three integral longitudinal reinforcing ribs extending along each resilient blade.

Referring to FIGS. 10 and 11, other embodiments may provide multiple longitudinal reinforcing ribs extending along the resilient blades.

An important advantage of this invention is that, in conjunction with features of the container and closure described in WO91/18799, this is the only child-resistant closure which can open in under half a turn, i.e. 180°, and more generally in approximately a quarter turn i.e. 90° or less. Also, in conjunction with the features of British Patent Appliction GB-A-2257693, it is the only child-resistant closure system which can be used in conjunction with either or both a tamper-evident ring and a foil seal whereby the seal of the closure is air and liquid proof after the foil has been removed.

This embodiment of the invention is by way of example only; modifications and alterations may be made within the scope of the invention.

I claim:

1. A child resistant container closure assembly comprising:

a container neck and a container closure;

said container neck carrying a first screw thread;

said container closure comprising an inner part and an outer part;

said inner part carrying a second screw thread for screw threaded engagement with said first screw thread of said container neck;

co-operating retaining projections on the inner and outer parts for retaining the inner part within the outer part, and for permitting limited axial movement of the inner part within the outer part;

a first set of castellations on the inner part;

a second set of castellations on the outer part arranged to inter-engage the first set of castellations on the inner part when the outer part is moved axially towards the inner part to permit full torque to be applied to the inner part;

a set of resilient blades extending from a first of the inner and outer parts towards a second of the inner and outer parts, said resilient blades bearing against said second of said inner and outer parts to urge said outer part axially in a direction away from said inner part such that said first and second sets of castellations are normally held out of inter-engagement;

each of said resilient blades having a remote end and comprising an abutment surface at said remote end, each of said resilient blades having a longitudinal cross-section which tapers towards said remote end, and a profile at an acute angle between each said resilient blade and the closure part from which said resilient blade extends being radiused;

said second of said inner and outer parts comprising a set of adjacent ratchet projections, each of said ratchet projections comprising a stop surface and a ramp surface, said stop surface being substantially radial and being constructed and arranged to engage the abutment surface of one of said resilient blades when the outer part is rotated in a first direction to apply the container closure to said container neck, thereby to permit fill torque to be applied to said inner part in said first direction of rotation;

each said ramp surface being constructed and arranged to cam one of the resilient blades over said ratchet projection when the outer part is rotated in a second direction opposite to said first direction so that said blades can slip relative to the ratchet projections if said outer part is rotated in said second direction without the first and second sets of castellations being in inter-engagement, said resilient blades transmitting only a limited torque to said ratchet projections owing to frictional engagement of said resilient blades slipping over said ramp surfaces of said ratchet projections; and wherein at least one of said resilient blades is provided with at least one reinforcing rib extending longitudinally along said at least one resilient blade.

2. A container closure assembly according to claim 1, wherein one or more of said resilient blades has a transverse cross-section which tapers towards said remote end of said one or more of said resilient blades.

3. A container closure assembly according to claim 1, wherein at least one of said reinforcing ribs has a cross-section which tapers towards said remote end of said at least one resilient blade.

4. A container closure assembly according to claim 1 wherein at least one of said reinforcing ribs is formed integrally with said at least one resilient blade.

5. A container closure assembly according to claim 1, wherein at least one longitudinal edge of said at least one resilient blade is curved.

6. A container closure assembly according to claim 1, comprising four said resilient blades and sixteen ramp surfaces.

* * * * *

UNITED STATES PATENT AND TRADEMARK OFFICE

CERTIFICATE OF CORRECTION

PATENT NO. : 5,743,419

DATED : April 28, 1998

INVENTOR(S) : Roger M. King

It is certified that error appears in the above-identified patent and that said Letters Patent is hereby corrected as shown below:

In the Claims

In claim 1, line 41, change "fill" to --full--.

Signed and Sealed this

Sixth Day of June, 2000

*Attest:*

Q. TODD DICKINSON

*Attesting Officer*

*Director of Patents and Trademarks*